US006367297B1

(12) United States Patent
Mottura

(10) Patent No.: US 6,367,297 B1
(45) Date of Patent: Apr. 9, 2002

(54) CYLINDER LOCK HAVING MAGNETICALLY OPERATIVE BIASSING MEANS

(75) Inventor: Sergio Mottura, Turin (IT)

(73) Assignee: Mottura Serrature di Sicurezza S.p.A., Turin (IT)

( * ) Notice: Subject to any disclaimer, the term of this patent is extended or adjusted under 35 U.S.C. 154(b) by 0 days.

(21) Appl. No.: 09/576,446

(22) Filed: May 22, 2000

(30) Foreign Application Priority Data

Jul. 21, 1999 (EP) ..... 99830465

(51) Int. Cl.[7] ..... E05B 47/00
(52) U.S. Cl. ..... 70/276; 70/413
(58) Field of Search ..... 70/276, 413, 356

(56) References Cited

U.S. PATENT DOCUMENTS

| | | | | | |
|---|---|---|---|---|---|
| 3,656,328 A | | 4/1972 | Hughes | | 70/276 |
| 3,660,999 A | * | 5/1972 | Janzen | | 70/276 |
| 3,935,720 A | * | 2/1976 | Boving | | 70/276 |
| 3,948,068 A | * | 4/1976 | Stackhouse | | 70/276 |
| 6,041,628 A | * | 3/2000 | Lin | | 70/276 |
| 6,041,631 A | * | 3/2000 | Vonlanthen | | 70/492 |

FOREIGN PATENT DOCUMENTS

| | | |
|---|---|---|
| DE | 10 36 702 | 8/1958 |
| DE | 22 01 281 | 7/1973 |
| DE | 25 52 230 | 6/1977 |
| EP | 0 571 311 | 11/1993 |

* cited by examiner

*Primary Examiner*—Lynne H. Browne
*Assistant Examiner*—John B. Walsh
(74) *Attorney, Agent, or Firm*—Sughrue Mion, PLLC

(57) ABSTRACT

In a cylinder lock, one or more tumblers of the rotatable cylinder are subjected to a magnetically operative biassing member.

6 Claims, 3 Drawing Sheets

CYLINDER LOCK HAVING MAGNETICALLY OPERATIVE BIASSING MEANS

BACKGROUND OF THE INVENTION

The present invention relates to cylinder locks, of the type comprising:

a fixed lock body or stator, having a cylindrical cavity, a cylinder or rotor, rotatably mounted within the cylindrical cavity of the fixed body and having an axial passage for receiving a key, a plurality of locking tumblers slidably mounted within radial holes of the rotatable cylinder, opening on said axial passage, said tumblers being adapted to be engaged at one end thereof by a key having a predetermined profile in order to arrange themselves in a position in which they enable a free rotation of the rotatable cylinder within the fixed body, a plurality of counter-tumblers, slidably mounted within holes which are formed in the fixed body of the lock and open on the cylindrical cavity of said fixed body, said holes for the counter-tumblers being adapted to become aligned with the holes for the tumblers in the rotatable cylinder at a given angular position of the latter, and means for biassing the tumblers radially towards the axis of the rotatable cylinder when the latter is at said given angular position.

In the conventional locks of the above indicated type, the above mentioned biassing means are constituted by coil springs arranged within the holes of the fixed body wherein the counter-tumblers are movable, so as to push the counter-tumblers against the respective tumblers, towards the axis of the rotatable cylinder. These locks enable a burgler to determine the profile of the key which can open the lock, by inserting a tool within the key hole and pushing the tips of the lock tumblers by this tool, against the action of the above mentioned coil springs.

SUMMARY OF THE INVENTION

The object of the present invention is that of proposing a new type of lock which has a higher degree of safety with respect to the conventional locks of the above indicated type.

In view of achieving this object, the invention provides a lock having all the above mentioned features and further characterized in that in the case of at least one of said tumblers the means for biassing this tumbler radially towards the axis of the rotatable cylinder are magnetically operative biassing means, which comprise a first permanent magnet arranged within the hole in the fixed body where the respective counter-tumbler is movable and a second permanent magnet associated with said key and adapted to draw the first permanent magnet towards the axis of the rotatable cylinder when the key is received within the rotatable cylinder, so that the first permanent magnet biasses the respective tumbler against the key.

Naturally, it is possible to provide one or more tumblers of the lock and, if desired, even all the tumblers of the lock, with magnetically operative biassing means.

According to a first solution, the above mentioned first permanent magnet is arranged within the respective hole of the fixed body between the respective counter-tumbler and an end wall of the hole. Alternatively, the first permanent magnet may be arranged within the respective hole of the fixed body between the respective counter-tumbler and the respective tumbler.

In order to improve the magnetic efficiency, preferably the tumbler and/or the respective counter-tumbler are made of ferromagnetic material.

The second permanent magnet is fixed within a seat formed in the key on a surface opposite to that which is for cooperating with the tumblers of the rotatable cylinder.

In case at least one of the tumblers of the rotatable cylinder has biassing means of the conventional type constituted by a coil spring arranged within the hole of the respective counter-tumbler, according to the invention the counter-tumblers associated with magnetically operative biassing means have a greater length than the counter-tumbler associated with coil spring biassing means. In this manner, a lock of conventional type can be transformed into a lock according to the invention with no modification to the geometry of the fixed body.

In case said key has a flattened active portion and accordingly the above mentioned axial passage for the key has a similar shape, having a general plane perpendicular to a plane containing the axes of the radial holes of the rotatable cylinder, the above mentioned active portion of the key has a first face having cavities adapted to cooperate with the tips of the lock tumblers and an opposite face in which the seat for each second permanent magnet is formed.

Due to the above mentioned features, when the key is not introduced into the lock, the first permanent magnet is not biassed towards the axis of the rotatable cylinder. Therefore it is impossible for a non-authorized person to introduce a tool into the key axial passage and press this tool against the tip of the above mentioned tumbler in order to determine the profile of the key which can open the lock. Thus, the lock according to the invention has a higher degree of safety with respect to the known locks.

BRIEF DESCRIPTION OF THE DRAWINGS

Further features and advantages of the invention will become apparent from the description which follows with reference to the annexed drawings, given purely by way of non limiting example, in which.

DETAILED DESCRIPTION OF THE INVENTION

Figure 1:
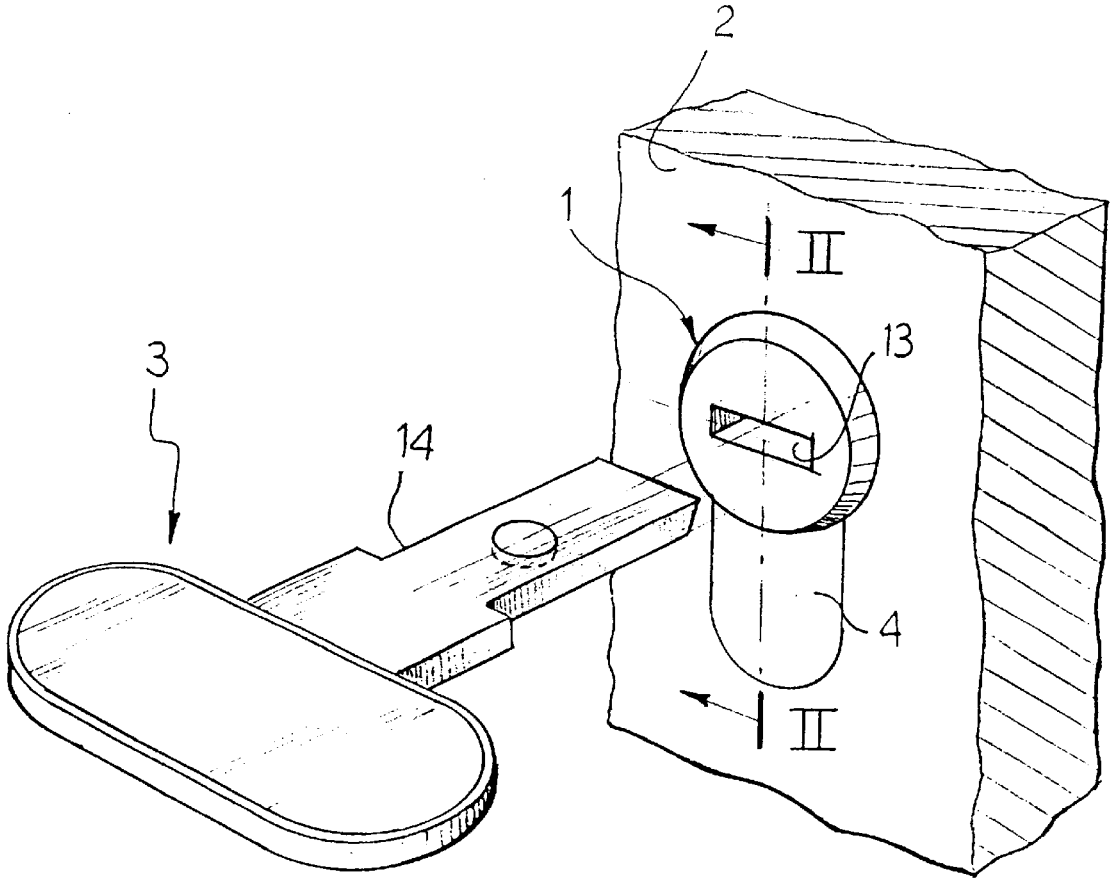
FIG. 1 is a perspective diagrammatic view of the lock according to the invention, with the associated key.

In FIG. 1, reference numeral 1 designates a cylinder lock associated with a door frame 2 and adapted to cooperate with a key 3.

Figure 2:
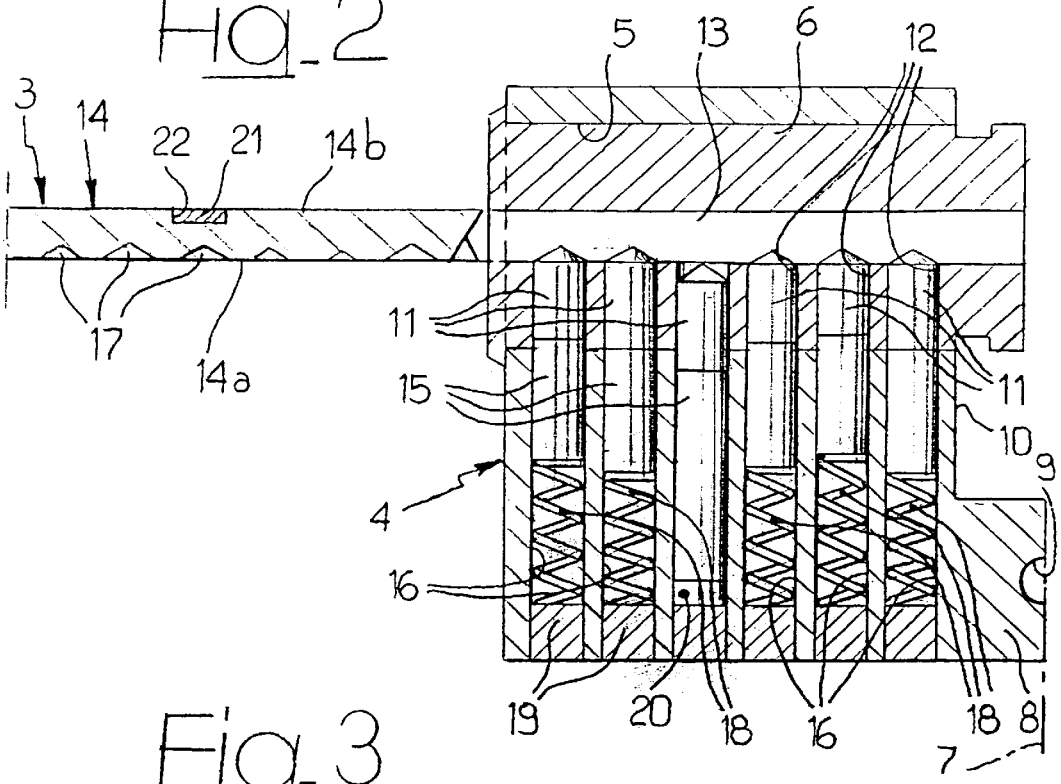
FIG. 2 is a cross-sectional view taken along line II—II of FIG. 1.

As shown in FIG. 2, the lock 1 is a cylinder lock, comprising a lock fixed body 4 having a cylindrical cavity 5 where a cylinder 6 is rotatably mounted.

In the case of the illustrated example, the fixed body 4 of the lock is of the type including two body sections (only one of which is visible in the drawings) arranged symmetrically with respect to a plane 7. The body section which is not shown in the drawings is identical and symmetrical to that shown. However, it is clearly apparent that the invention can be applied to any configuration of the fixed body. Also, in the case of the illustrated example, the two body sections are connected to each other by a bridge-like portion 8 in which a threaded hole 9 is formed for engagement of a screw (not shown) for securing the body 4 to the lock supporting structure 2. The details of construction are not shown herein since they can be made in any known way and since they do not fall within the scope of the present invention. The same applies to the rotatable pawl mounted onto cylinder 6, which occupies the gap 10 between the two body sections defined by the bridge-like portion 8.

According to the conventional art, the rotatable cylinder 6 is provided with a plurality of locking tumblers 11 which are slidably mounted within radial holes 12 formed in the cylinder 6 and opening on an axial passage 13 formed in the rotatable cylinder 6 and adapted to receive the active portion 14 of the key. As shown in FIG. 1, in the case of the example described herein, the active portion 14 of the key 3 has a substantially flattened shape with a rectangular cross-section, and the passage 13 has a similar shape, with a general plane perpendicular to the plane containing the axes of the tumblers 11.

Reference numeral 15 designates a plurality of counter-tumblers which are slidably mounted, according to the conventional art, within holes 16 which are formed in the fixed body and open on the cylindrical cavity 5 of the lock. The holes 16 are adapted to become aligned with the radial holes 12 of the rotatable cylinder 6 at a given angular position of the latter.

The tips of the tumblers 11 facing towards passage 13 which is for receiving the key are for cooperation with cavities 17 formed on a first face 14*a* of the active portion 14 of the key 3, so that when this active portion 14 is fully received within passage 13, the tumblers 11 are each brought to an axial position which does not prevent the free rotation of the rotatable cylinder 6 within cavity 5 of the fixed body 4.

Also in the case of the illustrated example, all the tumblers 11 of the lock, except for one of them, are radially biassed towards the axis of the rotatable cylinder 6 by coil springs 18 which are interposed within the respective holes 16 between the respective counter-tumblers 15 and a closing element 19 which defines an end wall of the hole. However, according to the invention, one of the tumblers 11 is not subjected to the action of a coil spring. In this case, between the respective counter-tumbler 15 (which has a greater length than the other counter-tumblers 15) and the closure element 19 there is interposed a permanent magnet 20, in form of a circular disk, and a second magnet 21 is fixed within a seat 22 formed on the face 14*b* of the active portion 14 of key 3, opposite to face 14*a* having cavities 17, so that when the key 3 is received within passage 13, magnet 21 draws magnet 20, so that the counter-tumbler 15 and the tumbler 11 associated with magnet 20 are biassed against the key. In order to improve the magnetic efficiency, the tumbler 11 and the counter-tumbler 15 which are associated with magnet 20 are preferably constituted of ferro-magnetic material.

Figure 3:
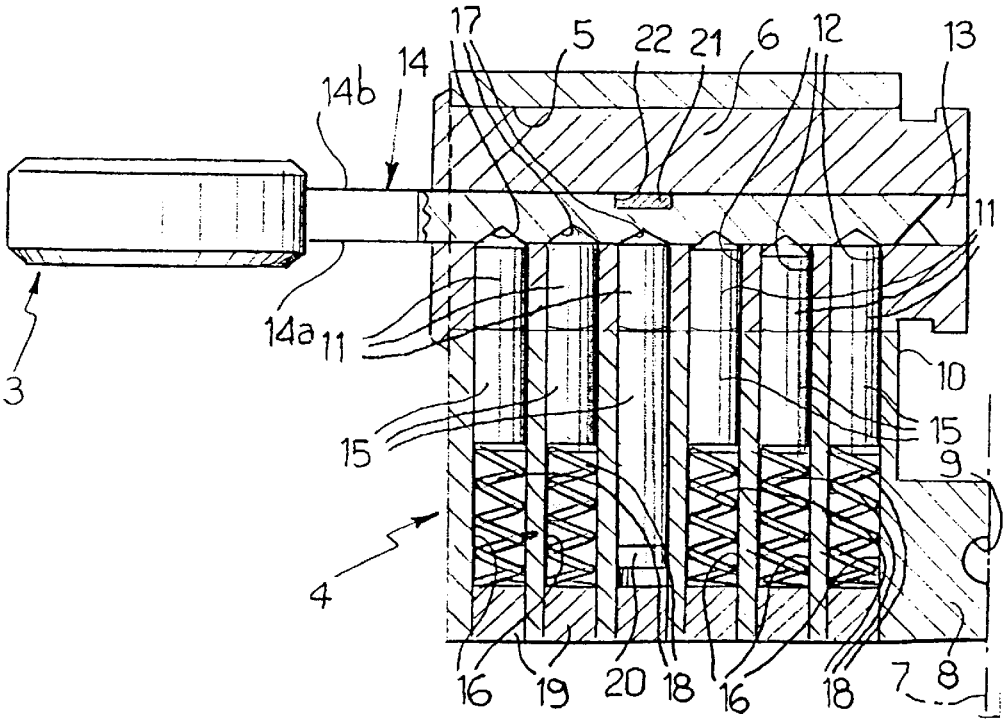
FIG. 3 shows the cross-section of FIG. 2 in a different operative condition.

FIG. 3 of the annexed drawings shows the condition of the lock when the key is introduced, with magnet 20 which, being drawn by magnet 21, keeps tumbler 11 associated therewith against the key. When the key is withdrawn, the tumbler 11 associated with magnet 20 is no longer biassed towards passage 13, so that it is free to fall within the respective hole 16. Therefore, if a burgler introduces a tool into passage 13, he is not able to press this tool against the above mentioned tumbler, since the latter is not biassed by any spring. For this reason, therefore, the lock according to the invention has a higher safety degree than the known locks.

Figure 4:
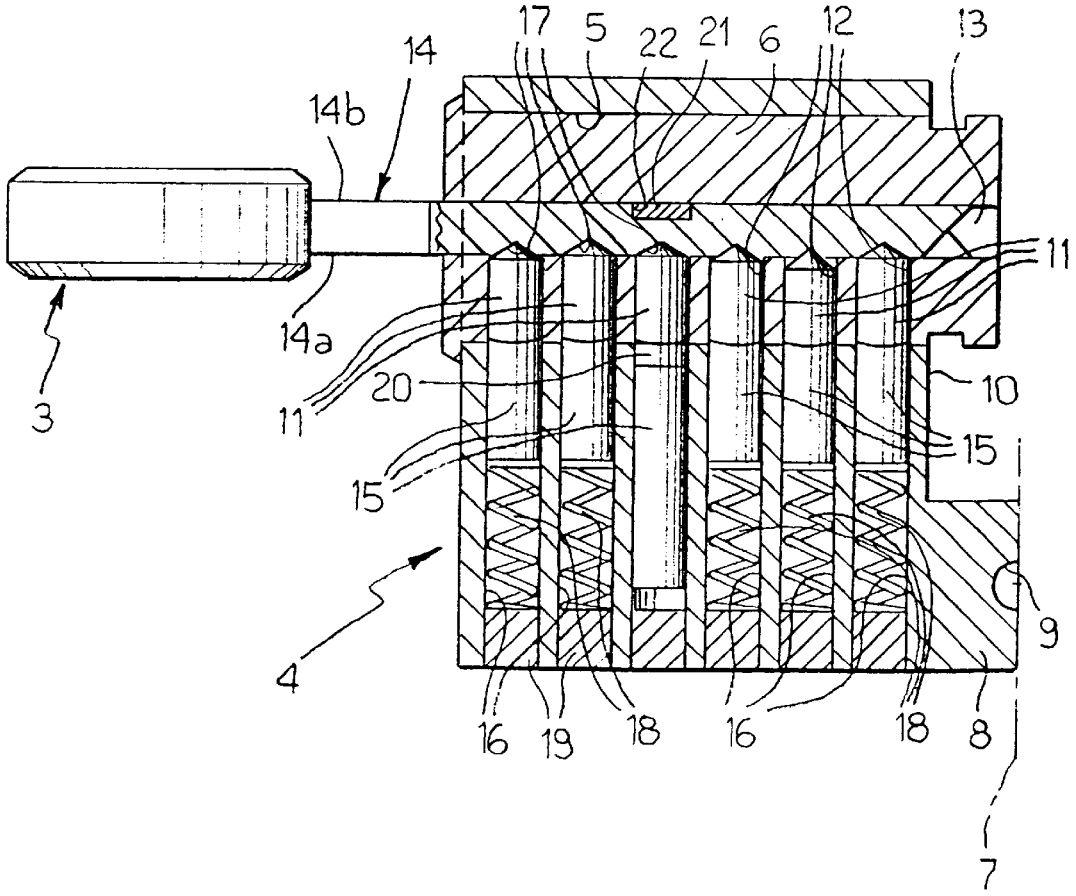
FIG. 4 shows a variant of FIG. 2.

FIG. 4 shows a variant in which magnet 20 is interposed between the respective tumbler 11 and the respective counter-tumbler 15.

Naturally, it is possible to replace the biassing spring 18 with the magnet 20 and to provide a cooperating magnet 21 on the key for more than one tumbler of the lock and, if desired, for all lock tumblers.

Furthermore, while the principle of the invention remains the same, the details of construction and the embodiments may widely vary with respect to what has been described and illustrated purely by way of example.

For example, rather than providing a magnet 21 on the key, this magnet could be provided within hole 16 adjacent to magnet 20, with polarities such as to obtain a repulsion force between the two magnets 20, 21 which would give rise to a force applied to tumbler 11. This solution could be applied both in the case of FIG. 3, and in the case of FIG. 4.

What is claimed is:

1. Cylinder lock, comprising:

a lock fixed body or stator, having a cylinderical cavity, a cylinder or rotor, rotatably mounted within the cylindrical cavity of the fixed body and having an axial passage for introduction of a key, a plurality of locking tumblers which are slidably mounted within radial holes of the rotatable cylinder which open on said axial passage, said tumblers being adapted to be engaged at one end thereof by a key having a predetermined profile so as to arrange themselves to a position in which they enable a free rotation of the rotatable cylinder within the fixed body, a plurality of counter-tumblers slidably mounted within holes which are formed in the fixed body of the lock, and open on the cylindrical cavity of said fixed body, said holes for the counter-tumblers being adapted to become aligned with the holes of the tumblers in the rotatable cylinder at a given angular position of the latter, and means for biassing the tumblers radially towards the axis of the rotatable cylinder when the latter is at said given angular position, wherein in the case of at least one of said tumblers, said means for biassing the tumbler radially towards the axis of the rotatable cylinder are magnetically operative biassing means which comprise a first permanent magnet arranged within the hole of the fixed body where the respective counter-tumbler is movable, and a second permanent magnet associated with said key and adapted to draw the first permanent magnet towards the axis of the rotatable cylinder when the key is received in the rotatable cylinder, so that the first permanent magnet biasses the respective tumbler against the key, wherein the second permanent magnet is fitted within a seat formed in the key on a surface opposite of that which is for cooperating with the tumblers of the rotatable cylinder, and wherein said key has a flattened active portion and said axial passage has a similarly flattened shape with a general plane perpendicular to a plane containing the axes of the radial holes of the rotatable cylinder, said active portion of the key having a first face with cavities adapted to cooperate with the tips of the tumblers of the lock, wherein each second permanent magnet is fitted within a seat formed on a substantially planar face of the key opposite to said first face.

2. Lock according to claim 1, wherein the first permanent magnet is arranged in the respective hole of the fixed body between the respective counter-tumbler and an end wall of the hole.

3. Lock according to claim 1, wherein the first permanent magnet is arranged in the respective hole of the fixed body between the respective counter-tumbler and the respective tumbler.

4. Lock according to claim 1, in which for at least some of the tumblers of the rotatable cylinder the biassing means are of the conventional type constituted by a coil spring arranged within the hole of the respective counter-tumbler, wherein the counter-tumblers associated with the magnetically operative biassing means have a greater length than the counter-tumblers associated with coil spring biassing means.

5. Lock according to claim 1, wherein each tumbler associated with a magnetically operative biassing means is made of ferro-magnetic material.

6. Lock according to claim 1, characterized in that each counter-tumbler associated with magnetically operative biassing means is made of ferro-magnetic material.

* * * * *